US005356232A

United States Patent [19]

Skinner

[11] Patent Number: 5,356,232

[45] Date of Patent: Oct. 18, 1994

[54] UNIFIED WRITING INSTRUMENT AND ERASER DISPENSER

[76] Inventor: Andrew J. Skinner, 57 Woodlawn Dr., Williamstown, Mass. 01267

[21] Appl. No.: 102,112

[22] Filed: Aug. 4, 1993

Related U.S. Application Data

[63] Continuation of Ser. No. 781,921, Oct. 24, 1991, abandoned.

[51] Int. Cl.[5] ..... B43K 29/02

[52] U.S. Cl. ..... 401/52; 401/29; 401/65

[58] Field of Search ..... 401/65, 52, 29, 31; 15/429, 433, 434

[56] References Cited

U.S. PATENT DOCUMENTS

| | | | |
|---|---|---|---|
| 1,411,117 | 3/1922 | Mason, Jr. | 401/65 X |
| 1,671,393 | 5/1928 | Zantow | 15/429 |
| 2,164,433 | 7/1939 | Smith | 15/429 |
| 2,173,361 | 9/1939 | Gorrell | 401/52 |
| 2,286,878 | 6/1942 | Tefft et al. | 15/429 |
| 2,452,795 | 11/1948 | Savoie | 15/429 |
| 2,532,037 | 11/1950 | Robbins | 15/429 |
| 2,812,744 | 11/1957 | Masternick | 15/429 |
| 3,099,251 | 7/1963 | Hertz | 15/429 |
| 4,904,101 | 2/1990 | Petterson . | |
| 5,015,111 | 5/1991 | Petterson . | |
| 5,018,891 | 5/1991 | Kageyama et al. . | |
| 5,022,774 | 6/1991 | Kageyama et al. . | |
| 5,207,522 | 5/1993 | Kageyama et al. | 401/52 |

FOREIGN PATENT DOCUMENTS

| | | | |
|---|---|---|---|
| 82600 | 4/1991 | Japan | 401/29 |
| 926 | 4/1862 | United Kingdom | 401/29 |

*Primary Examiner*—Steven A. Bratlie
*Attorney, Agent, or Firm*—Kenyon & Kenyon

[57] ABSTRACT

A combined writing instrument and eraser dispenser wherein a twist and click actuator (4) is rotatably and axially slidable within an outercasing (5). A portion of the twist and click actuator extends from within a tail of the outercasing enough to provide a grip (4c) for twisting and clicking. Ensconced within the twist and click actuator is an eraser carriage (2), which holds a long eraser (3). The eraser carriage has two raised projections (2b) which sit in two cut away grooves (4b) running longitudinally in the twist and click actuator, and thus the twist and click actuator and the eraser carriage are relatively nonrotatable but are relatively axially slidable. Thereadably engaged within the eraser carriage is a lead pipe (1) which could be the lead pipe of a mechanical pencil or the ink cartridge of a ball point pen. Relative twisting of the eraser carriage and the lead pipe causes a relative axial motion. The lead pipe has a noncircular cross-section (1b), near the front of the writing instrument, which is axially slidable through a noncircular throughput (5b) within the outercasing. The twist and click actuator rotatably, but not axially slidably, grasps the lead pipe with an inward semi-annular projection (4a) within its front end. The lead pipe and the outercasing are connected to a head assembly (6) particular to the writing instrument called for (pen, mechanical pencil, etc.) in the conventional manner.

6 Claims, 7 Drawing Sheets

UNIFIED WRITING INSTRUMENT AND ERASER DISPENSER

This application is a continuation of application Ser. No. 07/781,921, filed on Oct. 24, 1991, now abandoned.

BACKGROUND

1. Field of Invention

This invention relates to writing instruments which contain an eraser dispenser mechanism.

2. Description of Prior Art

There exist writing instruments, such as conventional mechanical pencils where the lead can be protracted or retracted with a hocking action, which also contain an eraser dispenser.

There are three general versions of such writing instruments. Two of these versions merely involve attaching an eraser dispenser to the back end of a shortened writing instrument of the conventional design, with some means provided to convey a knocking action to the front of the instrument. In the third version, the lead advancement mechanism and the eraser extension mechanism are part of a refill which is held within the shell of the writing instrument.

U.S. Pat. No. 5,022,774 to Kageyama et al. (1991) shows an example of the first of these versions, in which an outercasing of a mechanical pencil is made up of two sections. A rear outercasing section is rotatably and axially slidably connected to a front outercasing section. Within the rear outercasing is a spiral groove. An eraser holder has an outward diametric projection which engages the eraser holder with the spiral groove. The eraser holder is nonrotatably connected to, but is axially slidable with, the front outercasing. The extension or retraction of the eraser is accomplished by rotating the rear outercasing relatively with the front outercasing. There is a lead pipe axially slidably inserted within the front outercasing. The lead pipe serves as a conveyance of the knocking motion and stores any extra leads, in the conventional manner. A forward knocking motion of the rear outercasing knocks the lead pipe, which in turn, in the conventional manner, advances the lead. The lead pipe is returned to the non-knocking position by an elastic member in the front of the pencil, in the usual manner.

This first version has the disadvantage that the outercasing must be made up of two sections. The rear outercasing must be at least as long as the eraser, and as the purpose of the device is to provide a long eraser, the rear outercasing is relatively long. During knocking, this long rear outercasing forces the operator to grip the pencil towards the front, and it is difficult to knock the distant tail with a finger from the same hand that grips the front outercasing; frequently the hand interferes with the knocking motion. Thus, knocking is most easily accomplished by a two handed operation, in which each section must be gripped. This is difficult in comparison to the easy, single-handed, knocking process of conventional mechanical pencils where the pencil can be gripped as far back, with one hand, as is convenient.

Another disadvantage of this version is that replacing the leads is complicated. The rear outercasing must be separated from the front outercasing. This process exemplifies the failure to achieve a comprehensive unification of the eraser dispenser and writing instrument.

Another disadvantage of the first version is that the eraser holder takes up some space between the front end of the eraser and the rear end of the lead pipe, thus reducing the length of eraser that can be used in the pencil.

Yet another disadvantage of this first version is that the increased wall thickness of the rear outercasing needed for the spiral groove either restricts the diameter of the eraser or forces the rear outercasing to be large and unsightly.

Yet another disadvantage of the first version is that there are many parts which must be manufactured and assembled.

Yet another disadvantage of this version is that the outercasing section is comprised of two complicated elements and thus restyling the writing instrument by interchanging outercasings is costly and difficult.

U.S. Pat. No. 5,018,891 to Kageyama et al. (1991) shows an example of the second version of writing instruments with an attached eraser dispenser. This version solves the problem of a hand, which is gripping the pencil, interfering with the knocking motion. In this mechanical pencil, a tubular eraser holder has an inward aliametric projection which engages a spirally grooved shaft running axially within the eraser holder. The spirally grooved shaft is relatively nonrotatable with the outercasing. The eraser holder has an outward aliametric projection which engages a longitudinal groove within the inside of a tubular eraser guide. The eraser guide is axially slidable and rotatable within the rear end of the outercasing of the pencil, and extends beyond the end of the pencil enough to be gripped by fingers. The extension or retraction of the eraser is accomplished by rotating the eraser guide relatively with the outercasing of the pencil. The outercasing is comprised of two pieces, threadably connected. The spirally grooved shaft has a limited range of axial motion within the outercasing; an elastic member resists the spirally grooved shaft's forward motion and an annular inward projection within the outercasing prevents the spirally grooved shaft's rearward motion beyond a certain point. There is a lead pipe axially slidably inserted within the front outercasing, with a knocking cap on the rear end. The lead pipe serves as a conveyance of the knocking motion and stores any extra leads, in the conventional manner. A forward knocking motion of the eraser guide knocks the spirally grooved shaft, which in turn knocks the lead pipe, which in turn, in the conventional manner, advances the lead. The spirally grooved shaft is pushed rearward, allowing the lead pipe to return to the non-knocking position, by the aforementioned elastic member pushing rearwardly against the spirally grooved shaft.

A significant disadvantage of this second version is that the spirally grooved shaft, being at least as long as the desired axial motion of the eraser holder, is incorporated between the end of the lead pipe and the eraser. Thus the length of eraser that can be used in this pencil, for a given pencil length, is shorter than if the spirally grooved shaft could be removed without loss of capability. Since the desired axial motion is as long as the eraser, removal of the spirally grooved shaft without loss of other capability would double the amount of usable eraser in the device.

Another disadvantage of this version is that replacing the leads is complicated. The rear outercasing must be unscrewed from the front outercasing and then a knocking cap must be removed. This process exemplifies the failure to achieve a comprehensive unification of the eraser dispenser and writing instrument.

Another disadvantage of this version is that there are many parts which must be manufactured and assembled.

Yet another disadvantage of this version is that the outercasing section is comprised of two complicated sections and thus restyling the writing instrument by interchanging outercasings is costly and difficult.

Japanese patent 82600 to Koji Sakaoka (1991) is an example of the third version of writing instruments with an eraser dispenser. In this version, the lead advancement mechanism and the eraser dispenser are part of a refill to be inserted inside the body of a writing instrument. The body of the writing instrument is made up of two sections, or barrels. The front and rear barrels can rotate relatively but are not axially slidable. The refill, contained or inserted within the body of the writing instrument, has a lead pipe on its front, and attached to the front of the lead pipe is a typical lead advancement mechanism. The rear portion of the refill, attached to the rear end of the lead pipe, is a spirally grooved tube, with two diametrically opposed longitudinal slots in it. This spirally grooved tube interfaces with the front portion of the outer barrel of the writing instrument in such a way that they cannot rotate relatively. Inside the spirally grooved tube is an eraser holder, holding an eraser which is also inside the spirally grooved tube. Outside of the spirally grooved tube is a moving ring. The moving ring engages the eraser holder through the longitudinal slots in the spirally grooved tube. Thus, when the moving ring moves along the outside of the spirally grooved tube, the eraser holder and eraser move accordingly within the spirally grooved tube. The moving ring has an inward curved projection which engages the grooves of the spirally grooved tube so that when they are relatively rotated the moving ring moves along the spirally grooved tube. The moving ring also has two outward projections which axially slidably engage two guide grooves within the rear outer barrel of the writing instrument so that the moving ring and the rear outer barrel cannot rotate relatively. Thus, when the rear outer barrel and the front outer barrel are relatively rotated, the moving ring and the spirally grooved tube are also relatively rotated, and the moving ring moves along the outside of the spirally grooved tube, thereby extending or retracting the eraser.

The main goal of this design is that both the lead advancement mechanism and the eraser dispenser mechanism, comprising a refill, can be removed for cleaning, repair, or replacement.

There are, however, disadvantages to the refill version. The most significant of these is that the spirally grooved tube occupies substantially the same region that the eraser is stored in, and thus the diameter of the eraser is severely restricted. Since the volume of the eraser, for a given eraser length, increases as the square of the eraser radius, the amount of eraser this pencil provides is significantly limited. Another way in which this pencil limits the amount of eraser is that the eraser holder occupies some space between the end of the stored leads and the beginning of the eraser, and thus restricts the length of the eraser.

Another disadvantage of this version of mechanical pencil with an eraser dispenser is that there are many complicated interconnecting parts, which greatly increases the cost of manufacture.

In summary, the prior art in the field of adjustable writing instruments with eraser dispensers leaves several disadvantages:

(a) The outercasing of the writing instrument comprises two axially moveable sections in such a manner that the knocking process is complicated by the hand gripping the pencil.

(b) Spiral grooves, or spirally grooved elements, within the rear outercasing either restrict the diameter of the eraser or force the tail of the pencil to be large and unsightly.

(c) The length of erasers that can be used in these writing instruments is restricted by members between the front end of the eraser and the rear end of the lead pipe. The prior art invention which solves disadvantages (a) and (b) has a significant restriction in eraser length.

(d) The lead replacement process is complicated and requires the separation of the outercasing into two sections.

(e) The manufacture and assembly of these writing instruments is expensive and complicated due to the multitude of small interconnecting parts.

(f) The manufacture and assembly and restyling of these writing instruments is costly and complicated due to the plurality of complicated outercasing sections.

Objects and Advantages

Accordingly, several objects and advantages of the present invention are:

(a) to provide a combined writing instrument and eraser dispenser whose outercasing comprises a single element, so that the knocking process is as easy and convenient as it is in the use of conventional mechanical pencils without eraser dispensers;

(b) to provide a combined writing instrument and eraser dispenser whose outercasing is thin and attractive yet accommodates a wide diameter eraser;

(c) to provide a combined writing instrument and eraser dispenser whose eraser can be at least as long as the distance between the rear end of the lead pipe and the end of the writing instrument;

(d) to provide a combined writing instrument and eraser dispenser whose leads can be easily replaced merely by removing the eraser;

(e) to provide a combined writing instrument and eraser dispenser with few parts and whose production is simple and cheap; and (f) to provide a combined writing instrument and eraser dispenser whose restyling is accomplished simply and inexpensively because the outercasing is made up of one easily manufactured piece.

A further object and advantage is to provide a writing instrument with an eraser dispenser which can quickly and smoothly completely retract an eraser so that it is protected from dirt and grime, especially during the knocking process. Further objects and advantages are to provide a writing instrument with an eraser dispenser which can be manufactured quickly and easily, with few parts to be assembled, and which can be restyled quickly and simply by changing a simple one-piece outercasing. Still further objects and advantages are to provide a writing instrument with an eraser dispenser whose eraser replacement is infrequent and is easily accomplished. Still further objects and advantages will become apparent through a consideration of the following drawings and description.

DRAWING FIGURES

In the drawings, closely related figures have the same number but different alphabetic suffixes.

DESCRIPTION - FIRST PREFERRED EMBODIMENT

Figure 1:
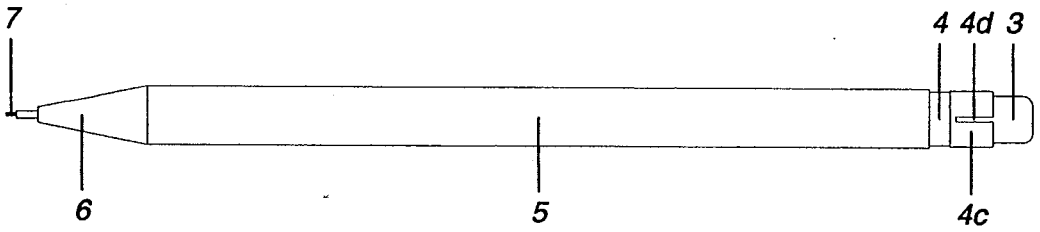
FIG. 1 shows a longitudinal side view of mechanical pencil equipped with an eraser dispenser according to the preferred embodiment of the present invention.
Figure 2A:
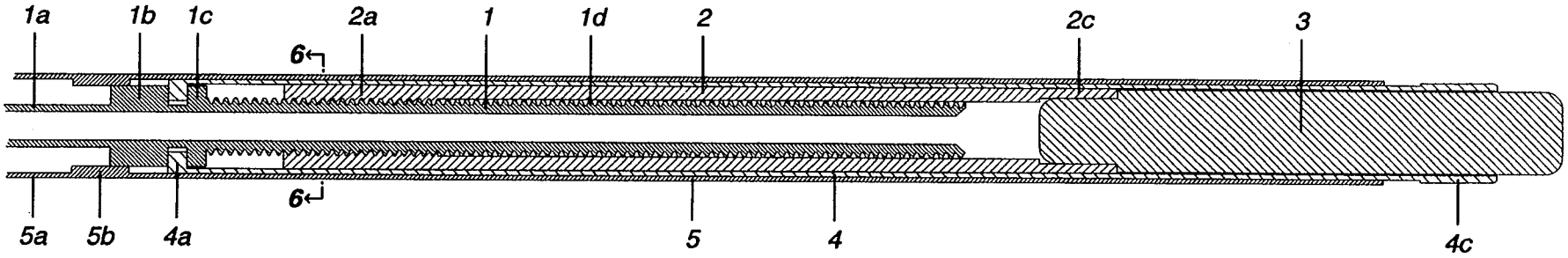
FIG. 2A shows a longitudinal sectional view of a writing instrument, constructed according to the preferred embodiment of the present invention, in the non-knocked position and with an eraser partially extended.
Figure 2B:
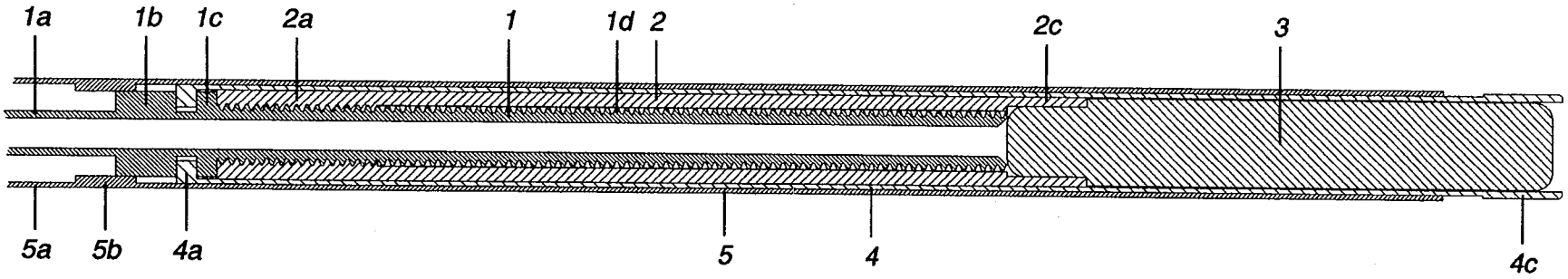
FIG. 2B shows a longitudinal sectional view of a writing instrument, constructed according to the preferred embodiment of the present invention, in the non-knocked position and with the eraser fully retracted.
Figure 2C:
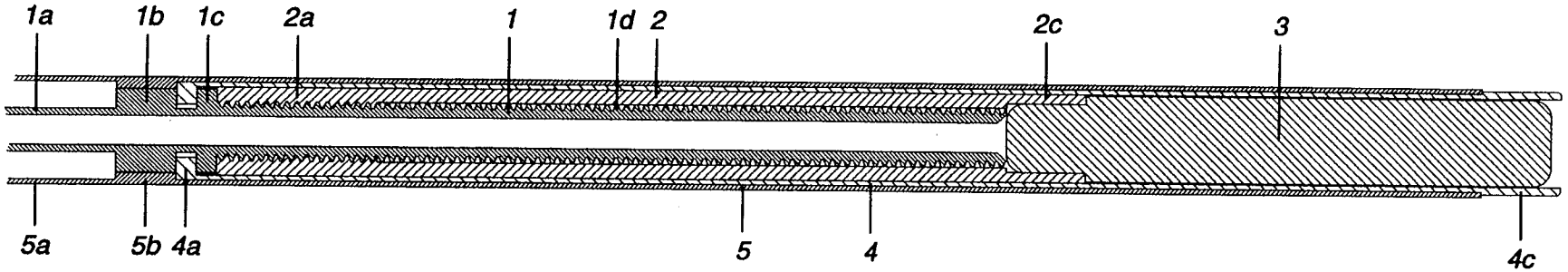
FIG. 2C shows a longitudinal sectional view of a writing instrument, constructed according to the preferred embodiment of the present invention, in the fully knocked position and with the eraser fully retracted.
Figure 2D:
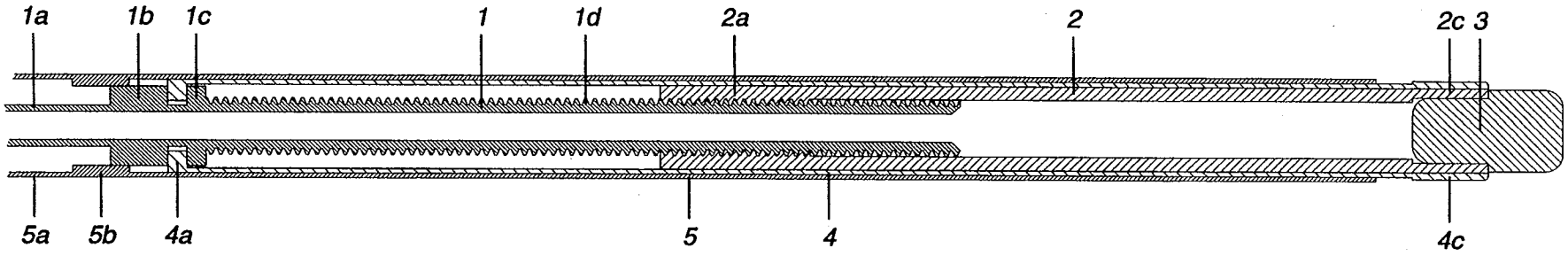
FIG. 2D shows a longitudinal sectional view of a writing instrument, constructed according to the preferred embodiment of the present invention, in the non-knocked position and with the eraser fully extended and almost fully worn away.
Figure 2E:
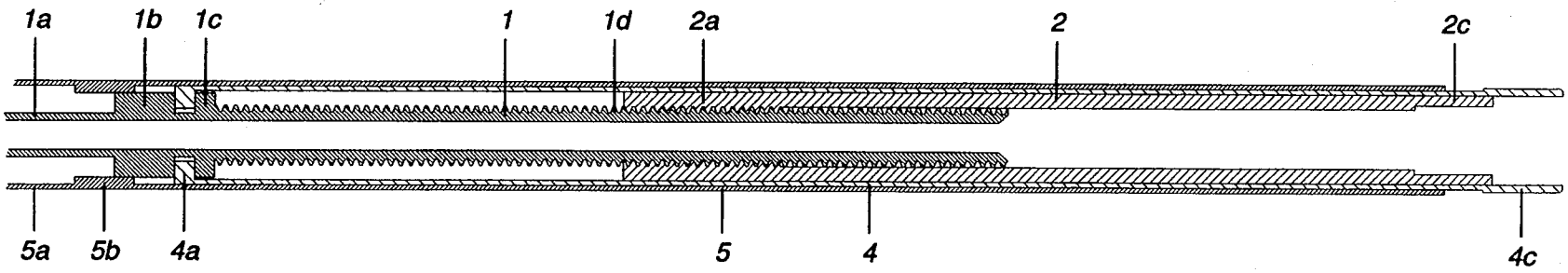
FIG. 2E shows a longitudinal sectional view of a writing instrument constructed according to the preferred embodiment of the present invention, in the non-knocked position and with the eraser removed.
Figure 3:
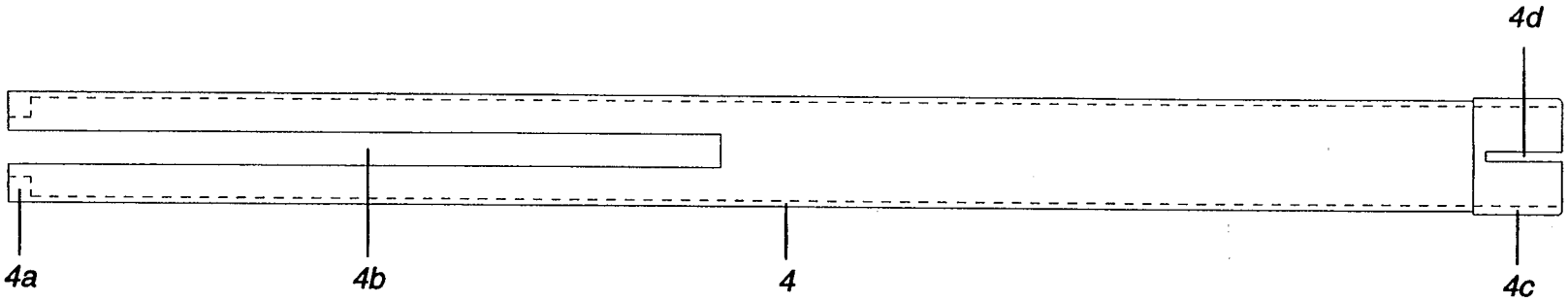
FIG. 3 shows an enlarged longitudinal side view of a twist and click actuator constructed according to the preferred embodiment of the present invention.
Figure 4:
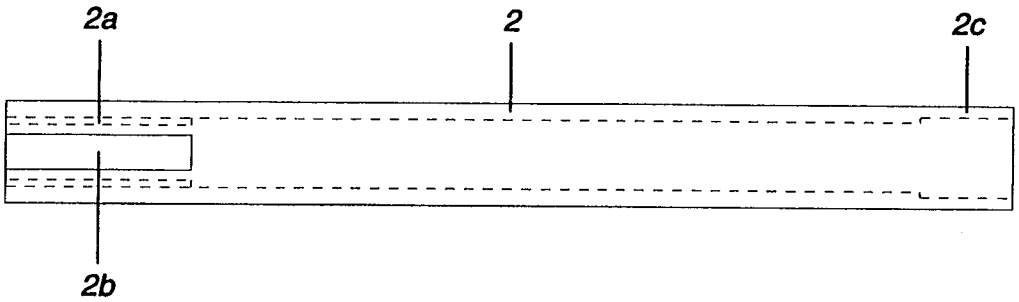
FIG. 4 shows an enlarged longitudinal side view of an eraser carriage constructed according to the preferred embodiment of the present invention.
Figure 6:
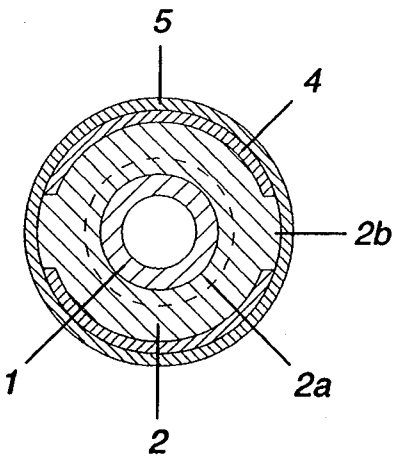
FIG. 6 shows a sectional view taken on line 6—6 of FIG. 2A.
Figure 5:
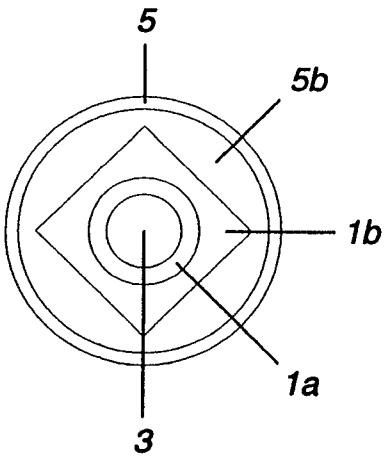
FIG. 5 shows a left end view of FIG. 2A.

The first preferred embodiment of the present invention is illustrated in FIGS. 1, 2A, 3, 4, 5, and 6.

An outercasing 5, comprises an elongated tubular element with an outercasing front end 5*a* and a noncircular throughput 5*b*. The outercasing front end 5*a* is connected to a head assembly 6, in the conventional manner. The noncircular throughput 5*b* is within the outercasing front end 5*a*.

Within the outercasing 5 is a twist and click actuator 4 comprising an elongated tubular element with two inward semi-annular projections 4*a*, two cut away grooves 4*b*, a grip 4*c*, and two cut away slots 4*d*. The two inward semi-annular projections 4*a* are within the front end of the twist and click actuator 4. The cut away grooves 4*b* extend longitudinally from the front end of the twist and click actuator 4, and continue for approximately half the length of the twist and click actuator 4. The grip 4*c* is at the back end of the twist and click actuator 4. The two cut away slots 4*d* run longitudinally in the grip 4*c*. The twist and click actuator 4 is rotatably and axially slidable within the outercasing 5.

Within the twist and click actuator 4 is an eraser carriage 2 comprising an elongated tubular element with a female threaded portion 2*a*, two raised projections 2*b* and an eraser holder portion 2*c*. The raised projections 2*b*, are near the front end of the eraser carriage 2. The raised projections 2*b* sit in and engage the cut away grooves 4*b* of the twist and click actuator. Thus the eraser carriage 2 is axially slidable, but not rotatable, within the twist and click actuator 4. The eraser holder portion 2*c* is at the back end of the eraser carriage 2. The eraser holder portion 2*c* is an extension of the tubular element which comprises the main portion of the eraser carriage 2. The female threaded portion 2*a* starts at the front end of, and runs for most of the length of, the eraser carriage 2.

Snugly fitted within the eraser holder portion 2*c* is an eraser 3 of the disintegrable type. The eraser 3 is unusually long and has a circular cross-section.

Within the eraser carriage 2 is a lead pipe I comprising a tubular element with a male threaded portion 1*d*, a lead pipe raised annular projection 1*c*, a noncircular cross-section 1*b*, and a lead pipe front end 1*a*. The noncircular cross-section 1*b* is near the lead pipe front end 1*a*. The lead pipe raised annular projection 1*c* is positioned behind the noncircular cross-section 1*b* so as to leave a gap just large enough to receive the two inward semi-annular projections 4*a* of the twist and click actuator 4. The outside of the lead pipe 1 is circular except for the noncircular cross-section 1*b* which is axially slidable, but not rotatable, within the noncircular throughput 5*b* of the outercasing 5. Thus the lead pipe 1 is axially slidable, but not rotatable, within the outercasing 5. The male threaded portion 1*d* extends rearwardly from the lead pipe raised annular projection 1*c*. The male threaded portion 1*d* mates with the female threaded portion 2*a* of the eraser carriage 2, and is approximately as long as the female threaded portion 2*a*.

The lead pipe front end 1*a* of the lead pipe 1 is connected to a conventional lead draw-out mechanism contained within a head assembly 6 in the conventional manner, so that when the lead pipe 1 is knocked forward a lead 7 will be advanced.

Operation-First Preferred Embodiment

The operation of the first preferred embodiment is illustrated in FIGS. 2A to 2E.

The extension and retraction of the eraser is accomplished by twisting the grip 4*c* relatively with the outercasing 5.

Twisting the eraser carriage 2 relatively with the lead pipe 1 causes a relative longitudinal motion of the eraser carriage 2 and the lead pipe 1 due to the engagement of the male threaded portion 1*d* and the female threaded portion 2*a*. The lead pipe 1 is prevented from rotating relative to the outercasing 5 by the engagement of the noncircular cross-section 1*b* with the noncircular throughput 5*b*. The eraser carriage 2 is prevented from rotating relative to the twist and click actuator 4 by the raised projections 2*b* inserted axially slidably into the cut away grooves 4*b* of the twist and click actuator 4. Thus turning the grip 4*c* of the twist and click actuator 4 while gripping the outercasing 5 causes a relative twisting of the eraser carriage 2 and the lead pipe 1, which in turn causes a relative longitudinal motion of the eraser carriage 2 and the lead pipe 1.

The inward semi-annular projection 4*a* in the front end of the twist and click actuator 4 is held rotatably between the noncircular cross-section 1*b* and the lead pipe raised annular projection 1*c* of the lead pipe 1 so that the lead pipe 1 and the twist and click actuator 4 are relatively rotatable but not relatively axially moveable. Thus when the turning of the twist and click actuator 4 causes the eraser carriage 2 to move longitudinally relative to the lead pipe 1, the eraser carriage 2 is also moving longitudinally relative to the twist and click actuator 4. Thus an eraser 3 snugly fitted within the eraser holder portion 2*c* of the eraser carriage 2 is moved axially relative to the twist and click actuator 4 by a relative twisting of the twist and click actuator 4 and the outercasing 5.

While erasing, the cut away slots 4*d* allow a small diametric compression of the grip 4*c* so that the eraser 3 is firmly held, and the eraser 3 won't compress along its entire length but only along the portion that extends beyond the grip 4*c*.

The advancement and adjustment of the lead 7 is accomplished by gripping the outercasing 5 and pushing forward on the eraser 3 or the grip 4*c* of the twist and click actuator 4.

The engagement of the inward semi-annular projection 4*a* in the front end of the twist and click actuator 4 with the noncircular cross-section 1*b* and the lead pipe raised annular projection 1*c* of the lead pipe 1 prevents any relative longitudinal motion of the twist and click actuator 4 and the lead pipe 1. Thus a forward motion of the twist and click actuator 4 relative to the outercasing 5 causes the lead pipe 1 to move forward relatively with the outercasing 5.

The engagement of the male threaded portion 1*d* and the female threaded portion 2*a* prevent the relative longitudinal movement of the lead pipe 1 and the eraser carriage 2 as long as there is no relative twisting. Thus a forward motion of the eraser 3 which is snugly fitted into the eraser holder portion 2*c* of the eraser carriage 2 causes a forward motion of the lead pipe 1. Thus a forward motion of the eraser 3 relative to the outercasing 5 causes a forward motion of the lead pipe 1 relative to the outercasing 5.

The head assembly 6 is connected to the outercasing 5 in the conventional manner so that the head assembly 6 is not relatively axially moveable with the outercasing 5. The lead pipe 1 is connected to the innards of the head assembly 6 in the conventional manner so that a forward motion of the lead pipe 1 relative to the head assembly 6 advances the lead 7 in the conventional manner. Thus a forward knocking motion of the twist and click actuator 4 or the eraser 3 relative to the outercasing 5 will advance the lead 7 in the conventional manner.

Replacement of the leads 7 is accomplished simply by pulling out the eraser 3 and dropping the replacement leads 7 into the tail end of the twist and click actuator 4. The twist and click actuator 4 and then the eraser carriage 2 will each successively guide the leads 7 into the lead pipe 1 which serves as a storage area for the leads 7.

Description-Second Preferred Embodiment

Figure 7:
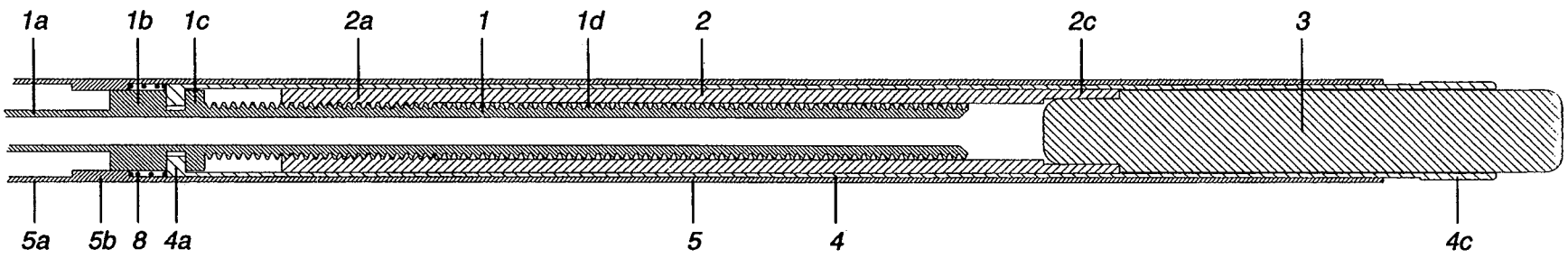
FIG. 7 shows a longitudinal sectional view of a writing instrument constructed according to a second preferred embodiment of the present invention, in the non-knocked position and with the eraser partially extended.

The second preferred embodiment of the present invention is illustrated in FIG. 7.

A combined writing instrument and eraser dispenser of the first preferred embodiment has a spring 8, between the inward semi-annular projection 4*a* and the noncircular throughput 5*b*.

Operation-Second Preferred Embodiment

In a conventional mechanical pencil the lead pipe 1 is returned to the non-knocking position by an elastic member ensconced in the head assembly 6. In the second preferred embodiment of the present invention the spring 8 replaces the usual elastic member in the head assembly 6 or supplements the usual elastic member in the head assembly 6 in order to help overcome any friction between the twist and click actuator 4 and the outercasing 5 when the lead pipe 1 is being returned to the non-knocking position.

Description-Third Preferred Embodiment

Figure 8A:
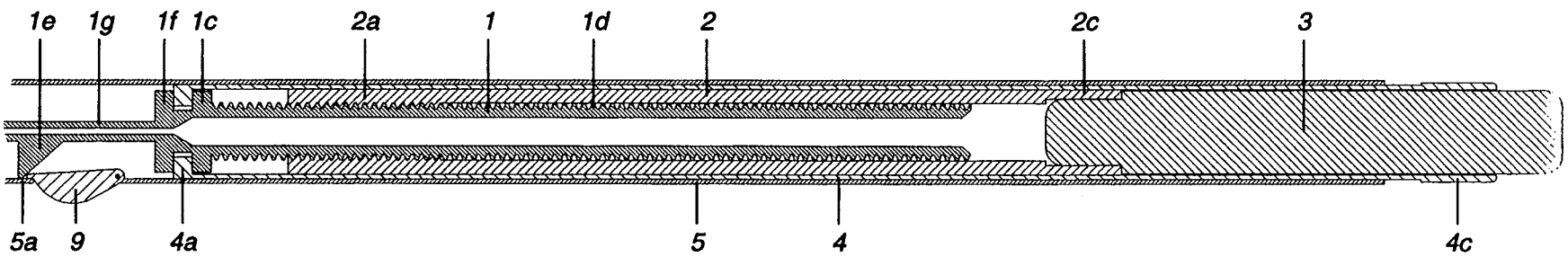
FIG. 8A shows a longitudinal sectional view of a writing instrument constructed according to a third preferred embodiment of the present invention, in the non-knocked position and with the eraser partially extended.

The third preferred embodiment of the present invention is illustrated in FIG. 8A.

A combined writing instrument and eraser dispenser of the first preferred embodiment incorporates a side clicker mechanism in the manner of conventional side clicker mechanical pencils. The lead pipe 1 has a second raised annular projection If from the lead pipe 1 instead of the noncircular cross-section 1*b*, a thin front end 1*g* of the lead pipe 1 instead of the lead pipe front end 1*a*, and a flat side clicker receiving projection 1*e* projecting from the thin front end 1*g*. The outercasing 5 has a side clicker built into the side of the outercasing front end 5*a*. The flat side clicker receiving projection forms a sloping flat plane facing the side clicker 9. The side clicker 9 has a rectangular cross-section so that the surface where the side clicker 9 and the flat side clicker receiving projection 1*e* meet is flat, and thus the lead pipe 1 is nonrotatable within the outercasing 5. The side clicker 9 is attached to the side of the outercasing front end 5*a* with a hinge so that the front end of the side clicker 9 can swing diametrically inward and outward of the outercasing front end 5*a*. The side clicker 9 and the flat side clicker receiving projection 1*e* meet when the writing instrument is in the non-knocked position and the front end of the side clicker 9 is fully unclicked.

Operation-Third Preferred Embodiment

Figure 8B:
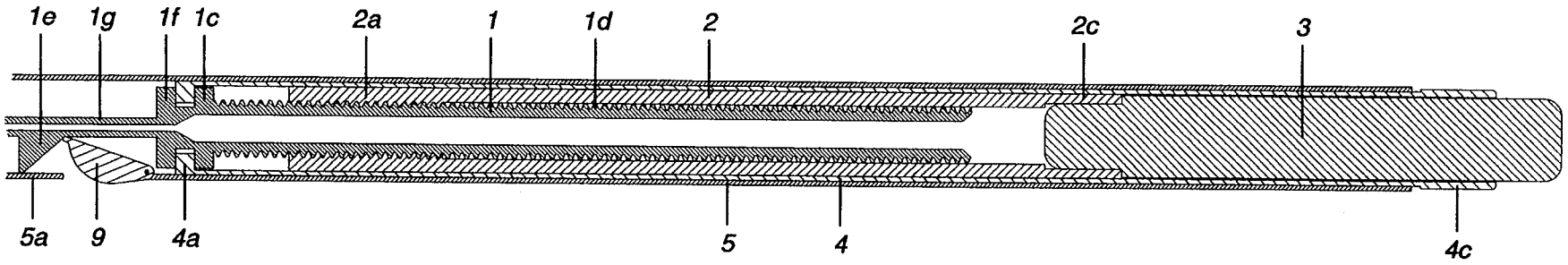
FIG. 8B shows a longitudinal sectional view of a writing instrument constructed according to the third preferred embodiment of the present invention, in the knocked position and with the eraser partially extended.

The operation of the third preferred embodiment is illustrated in FIGS. 8A and 8B.

The advancement and adjustment of the lead 7 is accomplished by gripping the outercasing 5 and pushing forward on the eraser 3, or the grip 4*c* of the twist and click actuator 4, or by pressing radially inward on the side clicker 9. The process is the same as that of the advancement of the lead in the first preferred embodiment, except for the operation which involves the side clicker. As the side clicker 9 moves radially inward the flat side clicker receiving projection 1*e* is forced forward, whereby the lead pipe 1 is advanced to the knocking position.

The extension and retraction of the eraser is accomplished by twisting the grip 4*c* relatively with the outercasing 5 in the same manner as in the operation of the first preferred embodiment. The process is the same as that of the extension and retraction of the eraser in the first preferred embodiment, except that the lead pipe 1 is prevented from rotating relative to the outercasing 5 by the engagement of the flat side clicker receiving projection 1*e* and the side clicker 9, rather than the engagement of the noncircular cross-section 1*b* with the noncircular throughput 5*b*.

Description-Fourth Preferred Embodiment

Figure 9:
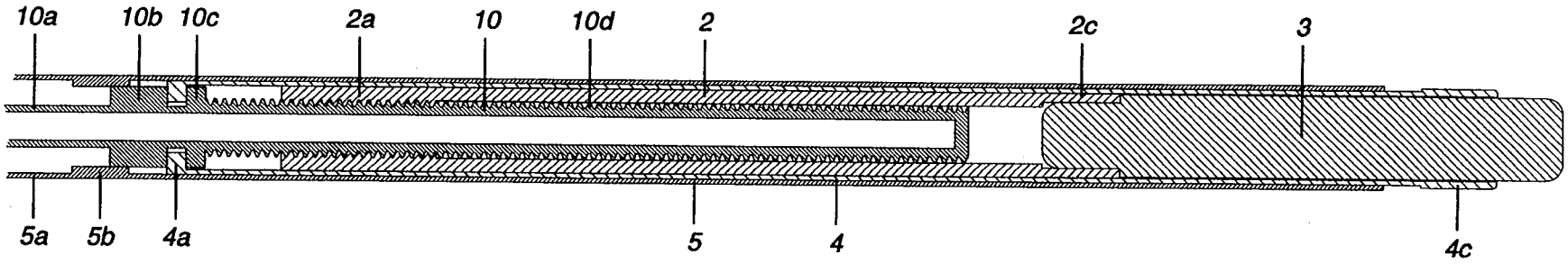
FIG. 9 shows a longitudinal sectional view of a writing instrument constructed according to the fourth preferred embodiment of the present invention, in the non-knocked position and with the eraser partially extended.

The fourth preferred embodiment of the present invention is illustrated in FIG. 9.

A combined writing instrument and eraser dispenser of the first preferred embodiment has an ink cartridge 10 in the place of the lead pipe 1, with an ink cartridge front end 10*a*, an ink cartridge noncircular cross-section 10*b*, an ink cartridge raised annular projection 10*c*, and an ink cartridge male threaded portion 10*d*. The ink cartridge front end 10*a* is attached to the head assembly 6 in the conventional manner, so that the ink cartridge 10 extends from the head assembly 6, and can thus be used as a writing instrument. Behind the ink cartridge front end 10*a*, the outside geometry of the ink cartridge 10 is the same as the outside geometry of the lead pipe 1.

Operation-Fourth Preferred Embodiment

The extension and retraction of the eraser is accomplished by twisting the grip 4*c* relatively with the outercasing 5, in the same manner as in the operation of the first preferred embodiment.

Summary, Ramifications, and Scope

Accordingly, the reader will see that the unified writing instrument and eraser dispenser of this invention provides a writing instrument which can quickly and easily extend and retract an extra long eraser. The eraser can be completely retracted so that, during the knocking process, the eraser is protected from grease from the operator's fingers. The eraser is so long that necessary replacement of the eraser is infrequent. Also, replacement of the eraser is easily accomplished, as is the replacement of the leads. This invention also provides a writing instrument and eraser dispenser combination which comprises few parts, one of which is a single piece outercasing, and thus manufacture and restyling is less costly. Furthermore, the writing instrument and eraser dispenser combination of this invention has the additional advantages that (a) its outercasing is a single element, so that a hand gripping the outercasing does not interfere with the knocking process;

(b) its outercasing can accommodate a standard diameter eraser without being itself large and unsightly;

(c) its eraser can be at least as long as the distance between the end of the lead pipe and the end of the writing instrument;

(d) its leads can be quickly and easily replaced by removing the eraser, without having to disassemble the outercasing;

(e) its production is simple and cheap; and (f) its restyling is accomplished simply and easily by replacing the one piece outercasing.

Although the above descriptions contain many specificities, these should not be construed as limitations on the scope of the invention, but rather as exemplifications of the preferred embodiments thereof. Many other variations are possible. For example the core writing element need not be a lead pipe or an ink cartridge, but could be, among other things, a wax crayon. The noncircular cross-section on the front of the core writing element could have any noncircular shape, such as square or hexagonal, so that its nonrotatability with the outercasing is maintained. The twist and click actuator could be removed entirely; the advancement of the lead would be accomplished by pushing on the eraser which would convey forward the necessary knocking action, and the extension and retraction of the eraser would be accomplished by twisting the eraser relative to the outercasing, provided that the eraser carriage nonrotatably gripped the eraser. The eraser could be replaced with a marker or tool, such as a wax crayon, lipstick, a knife blade, or a flashlight. The number of cut away slots in the twist and click actuator, both at the front and in the grip portion, need not be two, but could be any number. The relative nonrotatability of the twist and click actuator and the eraser carriage could be achieved by engaging any external noncircular cross-section of the eraser carriage with any internal noncircular cross-section of the twist and click actuator. For example, instead of the engaged raised and cut away portions described above, an engagement of an external hexagonal cross-section of the eraser carriage with an internal hexagonal cross-section of the twist and click actuator would also maintain their relative nonrotatability. The threaded portions of the eraser carriage and the lead pipe could be replaced by a spiral groove in one element and a raised pawl engaging the spiral groove. Accordingly, the scope of the invention should be determined not by the embodiments illustrated, but by the appended claims and their legal equivalents.

I claim:

1. A writing instrument comprising:

a) an elongated hollow outercasing;

b) a hollow twist and click mechanism disposed within the outercasing;

c) a hollow eraser carriage disposed within the twist and click mechanism and axially slidable but rotatably fixed with respect to the twist and click mechanism; and d) an elongated hollow lead pipe for storing lead, the lead pipe disposed within the outercasing and having a hollow rear end;

the lead pipe directly engaging the outercasing to prevent a relative rotation with the outercasing;

the lead pipe directly engaging the twist and click mechanism to prevent axial movement with respect to the twist and click mechanism so that axial movement of the lead pipe and the twist and click mechanism together operates to advance the lead; and the rear end of the lead pipe directly engaging the eraser carriage to permit axial movement upon relative rotation between the lead pipe and the eraser carriage.

2. The writing instrument as recited in claim 1, wherein the rear end of the lead pipe has external threads and the external threads of the rear end directly engage the eraser carriage to permit axial movement upon relative rotation.

3. The writing instrument as recited in claim 1, wherein the outercasing has a throughput; the lead pipe has a non-circular cross section portion; and the through put directly engages the non-circular cross section portion to prevent a relative rotation.

4. A writing instrument comprising:

a) an elongated hollow outercasing;

b) a hollow twist and click mechanism disposed within the outercasing;

c) a hollow eraser carriage disposed within the twist and click mechanism and axially slidable but rotatably fixed with respect to the twist and click mechanism; and d) an elongated hollow pipe for storing a writing material and having a rear end, the pipe disposed within the outercasing;

the pipe directly engaging the outercasing to prevent a relative rotation with the outercasing;

the pipe directly engaging the twist and click mechanism to prevent axial movement with respect to the twist and click mechanism so that axial movement of the pipe and the twist and click mechanism together operates to advance and retract the pipe; and the rear end of the pipe directly engaging the eraser carriage to permit axial movement upon relative rotation between the pipe and the eraser carriage.

5. The writing instrument as recited in claim 4, wherein the rear end of the pipe has external threads and the external threads of the rear end directly engage the eraser carriage to permit axial movement upon relative rotation.

6. The writing instrument as recited in claim 4, wherein the outercasing has a throughput; the pipe has a non-circular cross section portion; and the throughput directly engages the non-circular cross section portion to prevent a relative rotation.

* * * * *